United States Patent [19]

Weeks, Jr. et al.

[11] Patent Number: 4,754,643

[45] **Date of Patent: * Jul. 5, 1988**

[54] METHOD AND APPARATUS FOR AUTOMATICALLY INSTALLING MANDREL RIVETS

[75] Inventors: Arthur R. Weeks, Jr., Waterbury; Anthony D'Aquila, Trumbull; Sidney D. Schwartz, Hamden; Raymond H. Varian; Donald Viscio, both of Danbury, all of Conn.

[73] Assignee: USM, Farmington, Conn.

[ * ] Notice: The portion of the term of this patent subsequent to May 31, 2005 has been disclaimed.

[21] Appl. No.: 27,763

[22] Filed: Mar. 19, 1987

[51] Int. Cl.[4] ..... B21J 15/10

[52] U.S. Cl. ..... 72/391; 72/453.17; 72/11; 72/21; 72/27; 227/112; 29/809

[58] Field of Search ..... 72/391, 453.17, 453.19, 72/114, 420, 9, 11, 12, 20, 21, 23, 27; 227/53, 112, 118; 29/809, 816, 818, 243.53, 243.54; 294/64.1; 414/225, 737, 752, 744 B; 901/40; 271/98

[56] References Cited

U.S. PATENT DOCUMENTS

| | | | |
|---|---|---|---|
| 3,367,166 | 2/1968 | Newton et al. | 72/391 |
| 3,580,457 | 5/1971 | Henshaw | 72/391 |
| 3,630,067 | 12/1971 | Henshaw | 72/391 |
| 4,044,462 | 8/1977 | Anselmo | 29/809 |
| 4,065,001 | 12/1977 | Ohnaka | 414/737 |
| 4,515,302 | 5/1985 | Davern et al. | 227/58 |
| 4,592,136 | 6/1986 | Hirsch | 29/809 |

FOREIGN PATENT DOCUMENTS

| | | | |
|---|---|---|---|
| 2113718 | 9/1971 | Fed. Rep. of Germany | 72/391 |
| 2159752 | 12/1985 | United Kingdom | 72/391 |

OTHER PUBLICATIONS

A. E. DiMaio, "Portable and Automated Blind Riveting Systems", undated article.

Thomas E. Endres, "Automatic Installation of Blind Fasteners", undated article.

*Primary Examiner*—David Jones

*Attorney, Agent, or Firm*—Arthur B. Moore

[57] ABSTRACT

Apparatus and method for automated and semi-automated installation of blind rivets, comprising mechanical, pneumatic, and electronic subassemblies, with self-diagnostic capabilities. The system includes a rivet transfer arm external to the installation tool, which receives pneumatically fed rivets in a "home" position and transfers the rivets to an "advanced" position of alignment with the tool's nosepiece. A mandrel collection system routes separated mandrels from the tool to a remote receptacle through a channel under vacuum. Various sensors detect rivet placements, mechanism positions, and air pressure conditions, and signals from such sensors together with user inputs are received by a central processing unit (CPU). The CPU diagnoses the state of the installation system, produces command signals for a plurality of solenoid valves to regulate the system pneumatics, and reports status and fault conditions to the operator. The operating software may include self-correction routines, as for example one which recognizes unsuccessful loading of a rivet into the nosepiece and reattempts loading with a new rivet.

20 Claims, 5 Drawing Sheets

METHOD AND APPARATUS FOR AUTOMATICALLY INSTALLING MANDREL RIVETS

BACKGROUND OF THE INVENTION

The invention relates to blind rivet installation apparatus and automated methods for operating such apparatus. More particularly, the invention relates to automated and semi-automated rivet installation systems with built-in diagnostic systems for increased reliability.

A blind rivet comprises a tubular rivet body in which is mounted a mandrel having a head portion at the narrow end of the stem so that when this mandrel is pulled back in the rivet it upsets the rivet. When pulling-back of the mandrel is resisted with a predetermined force, the mandrel breaks off. A riveter that operates with such rivets typically has a housing formed at its front end with an aperture through which the rivet mandrel is engaged. Within the housing is a chuck that engages tightly around the mandrel and actuating mechanism which holds this chuck backwardly, thereby upsetting the rivet and breaking off the mandrel. The broken-off mandrel is removed from the riveter, perhaps by a collection system which avoids hazards due to broken-off mandrels ejecting from the riveter and collecting on the floor.

These tools fall generally into the classification of hand operated or power operated tools. An example of a hand operated tool is illustrated in U.S. Pat. No. 3,324,700. The power operated tools are for heavy duty continuous assembly line type operation, and examples of such tools are illustrated in U.S. Pat. Nos. 3,088,618 and 3,254,522. It is known to automate the process of feeding rivets to the riveter tool, as for example shown in U.S. Pat. No. 3,367,166 and U.S. Pat. No. 4,027,520. It is also known to automate the mandrel collection process as taught, for example, in U.S. Pat. No. 4,062,217, and U.S. Pat. No. 4,275,582. The most common approach to automatic rivet feed and disposal uses hydraulically or pneumatically powered mechanisms for guiding blind rivets to the riveting tool and extracting broken off mandrels therefrom.

One common shortcoming of prior art apparatus for automated or semi-automated feeding of rivets to the riveting tool is the failure of such systems to take into account the possible improper feeding of rivets to the riveter tool, which especially in the case of faulty rivets can fail due to misalignment between the rivet and the rivet engaging mechanism. Such misalignment can lead to jamming, and repeated unsuccessful attempts to insert a rivet can cause damage to the apparatus.

Other stages of the process of feeding rivets from a supply to the riveting tool and collecting broken off mandrels therefrom also raise risks of malfunctions. For the above reasons, the prior art has failed to successfully solve the problem of completely automating the rivet installation process in a reliable manner.

Accordingly, a primary object of the invention is to provide automated and semi-automated rivet installation systems of improved reliability. A related object is to provide the capability in such systems to diagnose and report to the operator various fault conditions.

Another object of the invention is to track and report the performance of the automated rivet installation apparatus.

SUMMARY OF THE INVENTION

In furthering the above and additional objects, the invention provides automated and semi-automated rivet installation systems of the type including an automatic rivet presentation assembly for delivering successive rivets from a bulk supply to the installation tool, and a mandrel collection assembly including a channel under vacuum for drawing spent mandrels from the tool and routing these to a remote receptacle; such systems incorporating a plurality of sensors to monitor the position of various mechanisms, and to monitor the delivery of a rivet to the rivet setting mechanism, and passage of a spent mandrel through the mandrel collection system. Signals representative of the monitored conditions are delivered to a processor which automatically controls the operation of the installation apparatus, including the operation of the rivet presentation and mandrel collection assemblies. The processor stores information indicating a normal sequence of operation of the mechanisms of the rivet installation system, and continues to compare signals from various location sensors and pressure sensors with this stored information to determine whether it should continue to produce command signals for normal operation. If a deviation from the expected sensor inputs is detected, the processor may take corrective action, produce an alarm output, shut the system down, etc.

Preferably, the rivet presentation assembly incorporates a transfer device for receiving rivets at an out-of-the-way position, transferring these to an advanced position aligned with an apertured receiving end of the tool, and inserting the rivets into the tool, with sensors to detect the presence of said transfer means at its first and second positions. The processor is responsive to signals from respective sensors to command the insertion of a rivet into the installation tool, and the delivery of a rivet to the transfer means. In the preferred embodiment, various moveable mechanisms are fluidically driven, and the processor provides command signals for a plurality of electronically actuated valves to control the mechanism motion. Most preferably, the mechanisms are pnuematically driven, using solenoid valves as control elements.

Another aspect of the invention is the mounting of the installation tool to move between a retracted position, where it receives rivets from the rivet presentation assembly, and an advanced position, where it sets rivets for installation into workpieces. The processor responds to a signal indicating the presence of a rivet in the nosepiece to cause the tool to move to its advanced position, and to a signal indicating the breaking of the mandrel, to retract the tool. Alternatively, the tool may be retracted a fixed time after delivery of the rivet to the nosepiece.

The invention also includes an advantageous method for installing rivets wherein the presence or absence of rivets at the setting mechanism is automatically sensed, to produce a signal indicating whether or not a rivet is delivered during a defined delivery period. If such delivery is not indicated, the system discards the rivet in the presentation assembly and reattempts delivery using a new rivet. Advantageously, the system further senses whether or not a spent mandrel exits from the installation tool, and delivers another rivet to the setting mechanism upon sensing the spent mandrel.

BRIEF DESCRIPTION OF THE DRAWINGS

The above and related aspects of the invention are illustrated with reference to the following detailed description of a preferred embodiment of the invention, which is to be taken together with the drawings in which:

FIG. 4 represents the "pressure on for nose load" diagram;

FIG. 5 represents the "two pressure cycle for nose load (if needed)" diagram; and FIG. 6 represents an internal bit generating diagram, accessory to FIG. 4.

DETAILED DESCRIPTION

Reference should now be had to FIGS. 1–6 for a detailed description of an automated rivet installation system in accordance with the preferred embodiment of the invention. Rivet installation system 10 is capable of both automatic and semi-automatic operation, and enjoys a modular design, which may be described in terms of mechanical, pneumatic, and electronic subsystems.

Mechanical Elements

Figure 1A:
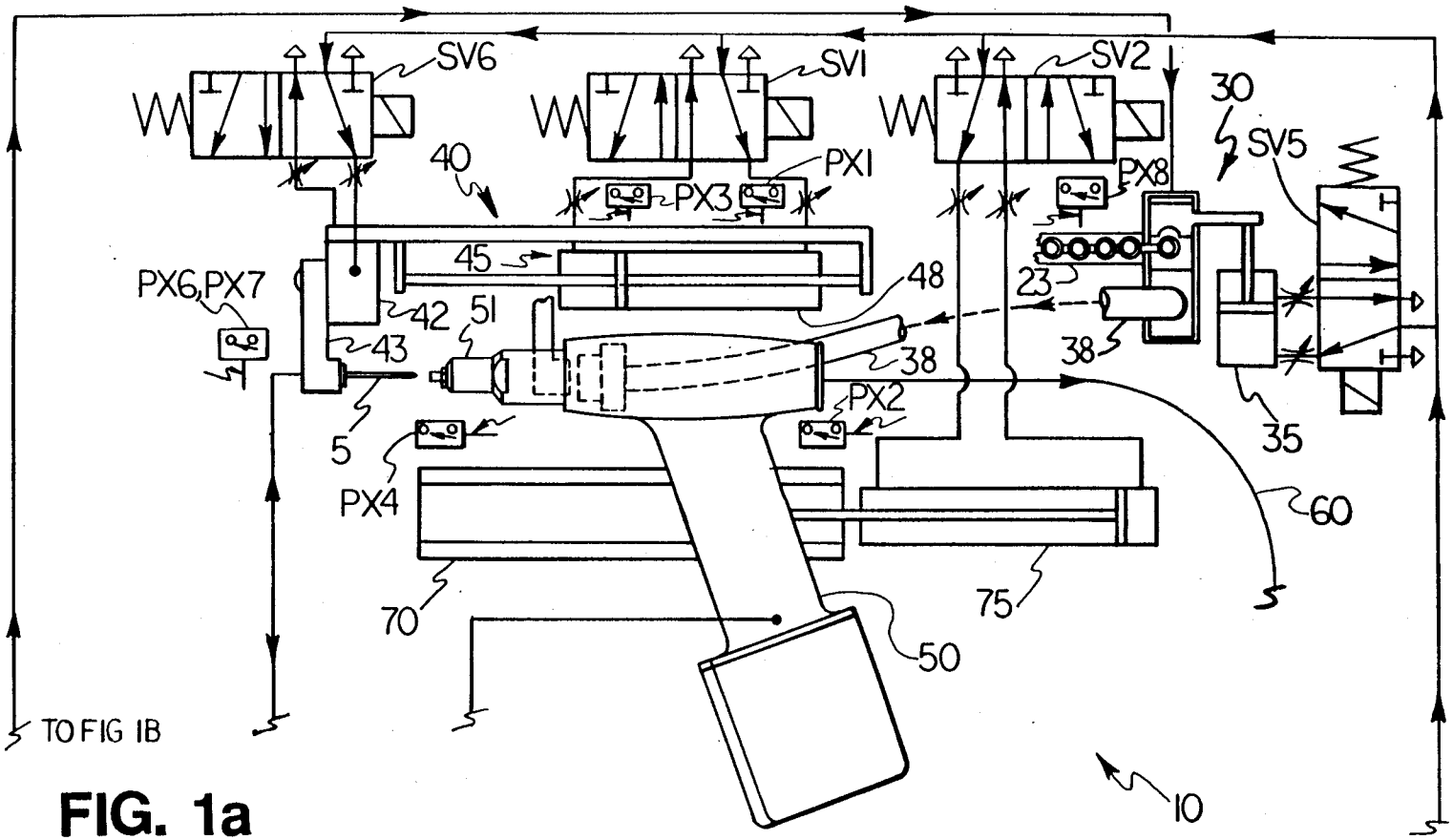
FIGS. 1A and 1B are portions of a complete figure and, when joined in a side-by-side relationship, form a complete figure hereinafter referred to as FIG. 1, said FIG. 1 being a schematic diagram of the pneumatic elements and selected mechanical elements of an automatic rivet installation machine.

With reference to FIG. 1, which shows highly-schematically various mechanisms of system 10, the operating mechanisms include a vibratory feedbowl (not shown), feed track 23, and escapement mechanism 30. Rivets falling from the bulk supply in the vibratory bowl are stacked in an inclined feed track 23, which accumulates a supply of rivets for escapement mechanism 30. The rivet escapement mechanism 30 includes an air cylinder 35 which periodically advances a rivet to the rivet transport hose 38. The rivet is blown through transport hose 38 to transfer assembly 40, which inserts rivets into riveting tool 50 as discussed below. The vibratory bowl, feed track, and escapement devices are found in the prior art (cf. commonly assigned U.S. Pat. No. 3,580,457), but transfer assembly 40 represents a novel, highly significant advance to the state-of-the-art which is the subject of a commonly assigned patent application of S. Schwartz et al. entitled "Rivet Presentation Device", U.S. Ser. No. 027,752 filed Mar. 19, 1987.

Principal elements of transfer assembly 40 include transfer slide 45 and a rotatably mounted transfer arm 43, which is rotated by rotary actuator 42. During normal operation, in order to receive a rivet from transport hose 38, the transfer slide 45 is retracted and the transfer arm is retracted, thereby positioning the transfer arm as shown at 45R in FIG. 2. At the start of a given rivet installation cycle, the transfer arm is in position 45R and a rivet 5 is held in place therein by a vacuum induced by vacuum transducer T1. The transfer slide is moved to its forward position by transfer slide cylinder 48, and then the transfer arm rotated to its out or advanced position 45A by rotary actuator 42. A positive pressure is induced in transfer arm 43 to blow the rivet 5 into the nose piece 51 of installation tool 50. Reference may be had to commonly assigned U.S. Pat. No. 3,254,522 for a disclosure of a pneumatically-actuated rivet installation tool having suitable setting and installation mechanisms. Upon setting and installation of blind rivet 5, the spent mandrel remaining in installation tool 50 is drawn out through mandrel collection hose 60 and collection system 68.

Pneumatic Elements

With further reference to FIG. 1, high-pressure air is supplied from pressure source 80 through solenoid valve SV7, which may be energized to allow supply air to pass through the particle filter PF1 and coalescing filter CF1, regulator R1, and pressure switch PS1. If the supply air pressure detected by PS1 is below a preset value, this switch will not allow the system to operate and the "air supply" warning light 106 (FIG. 3) will illuminate. Supply air above the threshold pressure is piped into the manifold 82 which branches clean air out to vacuum transducers T1 and T2 and pressure regulator R2, and the remaining air through lubricator L1 which supplies solenoid valves SV1, SV2, SV4, SV5, and SV6. Transport pressure regulator R2 routes air under pressure to escapement mechanism 30 for forcing rivets through transport hose 38 to transfer assembly 40. Vacuum transducer T2, which receives clean air via pressure regulator R3, induces a vacuum in the mandrel collection hose 60 and riveting tool 50 for collecting spent mandrels.

The operation of vacuum transducer T1 is controlled by a two-way solenoid valve SV3. In normal operation (valve SV3 not energized), vacuum T1 induces a vacuum in rotary transfer arm 43 to hold rivets therein. Energizing solenoid SV3 turns the vacuum in arm 43 to a positive pressure causing the ejection of rivet 5. Advantageously, the pressure reversal from negative to positive occurs relatively rapidly, to ensure that the rivet 5 will be propelled along the axis of insertion into tool 50. The use of a vacuum transducer controlled by a solenoid valve provides excellent pressure reversal characteristics for this purpose.

In an alternative embodiment (not illustrated) the rivet 5 is positioned by the transfer arm 43 closely adjacent the nosepiece 51, and rather than a rapid negative-to-positive pressure reversal the vacuum is simply relieved to permit its capture by a receiving mechanism within the nosepiece. The released rivet may be drawn into the receiving mechanism by a negative pressure, or inserted by the motion of transfer arm 43.

In the automated rivet installation system 10 shown in FIG. 1, tool 50 is reciprocably mounted in tool advance slide 70. In an alternative, semi-automated system a portable riveting tool 50 would be held by the operator for manual installation of rivets, in response to pressing and release of a trigger. Inasmuch as the semi-automatic and automatic modes of operation involve certain functional differences, the control electronics provides different operating routines in these two modes, as further explained below.

Now having reference to FIG. 1 and TABLE 1, in an operative embodiment of the invention solenoid valves SV1, SV2, SV4, SV5, and SV6 are four-way five port solenoid valves, while solenoid valves SV3 and SV7 are two-way solenoid valves. Actuation of valve SV1 causes the forward motion of transfer slide 45, via transfer slide cylinder 48. Energizing valve SV2 advances the riveting tool 50 within tool advance slide 70, via tool slide cylinder 75. Energizing solenoid valve SV4 pressurizes riveting tool 50 during a rivet setting period. Energizing solenoid valve SV5 causes the movement of the piston within rivet escapement cylinder 35 from its upper to lower positions (as seen in FIG. 1), thereby forwarding a rivet to hose 38 for transportation to the transfer arm 43. Energizing solenoid SV6 advances (rotates) the transfer arm 43. De-energizing any of the solenoid valves SV1, SV2, SV5 and SV6 causes the complementary motion to that described above, while de-energizing solenoid valve SV4 depressurizes the riveting tool 50 via quick dump valves QDV1, QDV2 with respective mufflers M1, M2. Energizing solenoid valve SV3 changes the pressure within transfer arm 43 from a vacuum to a positive pressure for ejecting a rivet therefrom. Energizing solenoid valve SV7 enables supply air to pass from the pressure source 80 into the system pneumatic circuit.

TABLE 1

| SOLENOID VALVE FUNCTIONS | |
|---|---|
| Reference Number | Function |
| SV1 | Transfer Slide Motion |
| SV2 | Tool Slide Motion |
| SV3 | Pressure/Vacuum to Transfer Arm |
| SV4 | Set Rivet |
| SV5 | Load Rivet into Escapement |
| SV6 | Rotary Actuator Motion |
| SV7 | Main Air Pressure ON/OFF |

TABLE 2

| PROXIMITY SWITCH FUNCTIONS | |
|---|---|
| Reference Number | Function |
| PX1, PX3 | Transfer Slide Position |
| PX2, PX4 | Tool Slide Position |
| PX5 | Ring Proximity (Mandrel Sensor) |
| PX6, PX7 | Rotator Position |
| PX8 | Rivet Stacking in Feed Rail |
| PX9 | Mandrel Collection Container Opened/Closed |

Electronic Subassembly

Figure 3:
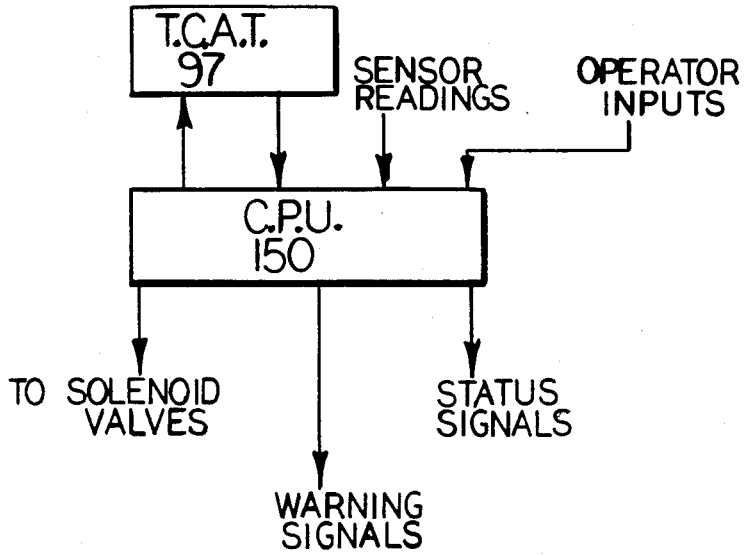
FIG. 3 is a partial circuit schematic diagram of the electronic control elements.

With reference to FIG. 3, the electronic elements of automated rivet installation system 10 include a central processing unit 150, various sensors and switches which provide inputs to the central processing unit; the various solenoid valves which receive output signals from the CPU; and the operator inputs and outputs at main panel 100 including in particular the Timer Counter Access Terminal 97 (TCAT). CPU 150 may communicate with a host computer (not shown), for example for data acquisition purposes.

Figure 1B:
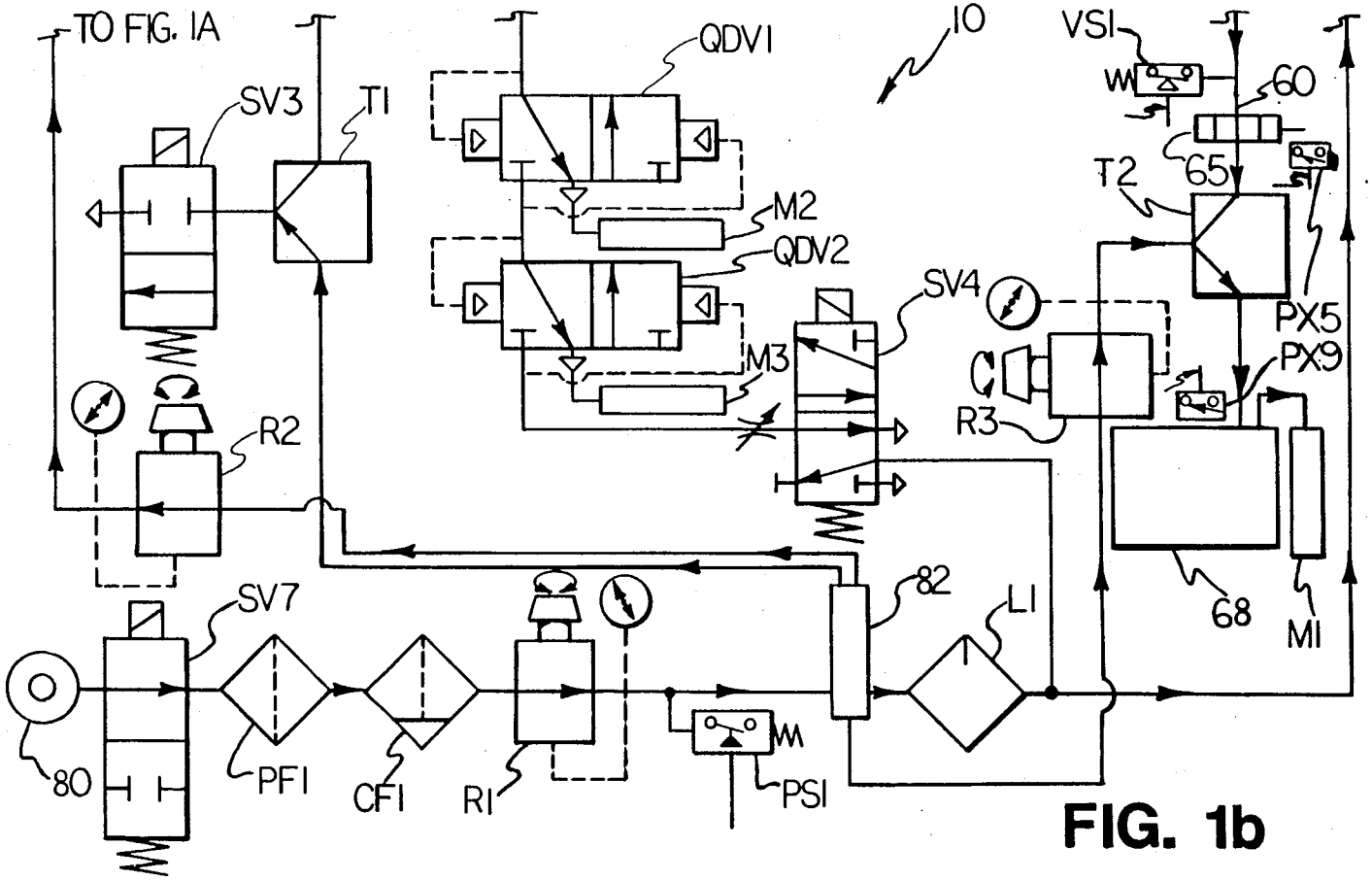

The inputs to the CPU 150 include signals from proximity switches PX1–PX9, the functions of which are summarized in TABLE 2. Proximity switches PX1 and PX3 sense the retracted and advanced states of the transfer slide 45, respectively. Proximity switches PX2 and PX4 similarly detect the retracted and advanced positions of tool slide cylinder 75, respectively. Proximity switch PX5 detects the presence of a spent mandrel within a ring 65 (FIG. 1B). Proximity switches PX6, PX7 detect the retracted and advanced positions of the rotating transfer arm 43, respectively. PX8, placed at a predetermined position along the rivet track 23, addresses whether rivets are stacked at least to that position. Switch PX9 detects that the mandrel collection system container 68 is open.

Vacuum switch VS1 registers the presence of a rivet in the nosepiece 51, which creates a sufficient negative pressure in the mandrel collection hose 60. Switch PS1 is triggered by the presence of an air pressure above a preset threshold value in accordance with the pneumatic system specifications.

Figure 2:
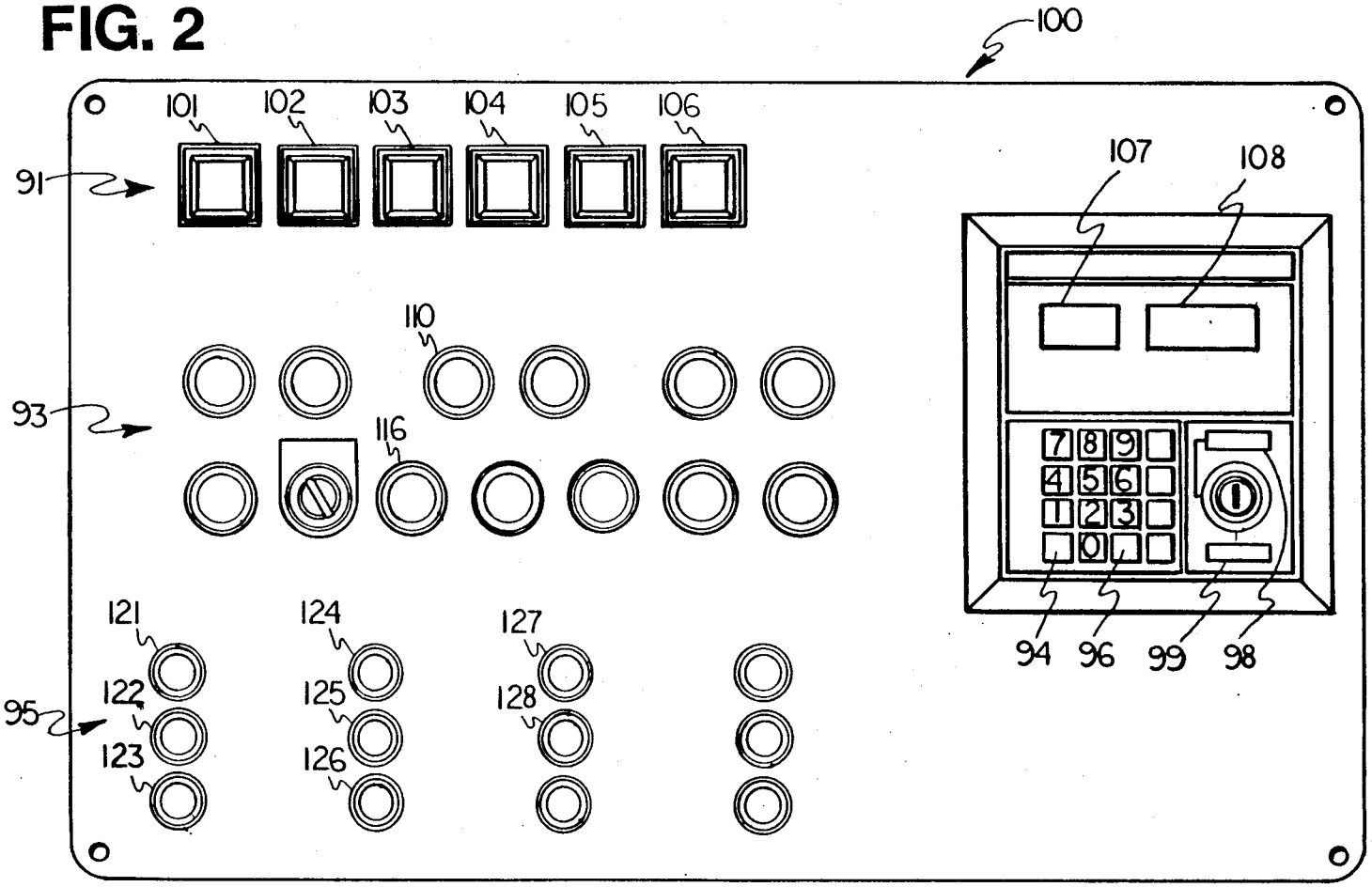
FIG. 2 is a plan view of the operator control panel.

FIG. 2 illustrates the layout of an operator control panel 100 for system 10. Elements 91 are system warning lights which indicate various alarm conditions as set forth in TABLE 3. Indicator 101 signals that no mandrel has been detected by sensor PX5 for a predetermined time interval after sensing of a rivet in the nosepiece. Indicator 102 signals that a cycle has not been completed within a prescribed time limit. Indicator 103 signals that the mandrel collection system is full. Warning light 104 signals that the door of the mandrel collection system container 68 is open. Indicator 105 signals slow rivet replenishment. Indicator 106, in response to a lack of signal from switch PS1, signals that the air supply has fallen below the prescribed minimum level. Some of these alarm conditions lead to cycle shutdown.

TABLE 3

| SYSTEM WARNINGS (FIG. 2) | |
|---|---|
| Reference Number | Function |
| 101 | No Mandrel |
| 102 | Cycle Time Exceeded |
| 103 | Mandrel Collection System Full |
| 104 | Mandrel Collection System Open |
| 105 | Slow Rivet Feed |
| 106 | Low Air Supply |

TABLE 4

| SYSTEM STATUSES (FIG. 2) | |
|---|---|
| Reference Number | Status |
| 121 | Tool Advanced |
| 122 | Tool Retracted |
| 123 | Transfer Slide Advanced |
| 124 | Transfer Slide Retracted |
| 125 | Transfer Arm Advanced |
| 126 | Transfer Arm Retracted |
| 127 | Rivet in Nose |
| 128 | Mandrel Sensed |

Various system control inputs (e.g. push buttons) are shown at 93. These include a button 110 to allow the operation to jog the transfer arm 43 into alignment with the nosepiece 51 in mechanical setup of system 10, and a stop button 116 which brings the moving parts of the system to a stop at the completion of any motion which is in progress at the time of pressing the button. An array of "System Status" indicators, at 95, signal various statuses as shown at TABLE 4. Assembly 97 allows the operator to enter, amend and display both preset and accumulated count values and both preset and actual elapsed timer values via preset and accum entry keys 94, 96 and modify/disply mode switch 99. TCAT 97 may be used for example to set a prescribed time interval for energizing solenoid valve SV4 to pressurize installation tool 50 for rivet setting; a maximum allowed cycle time; or a maximum number of spent mandrels which may be collected by the mandrel collection system container 68. TCAT 97 may be used not only in the operating routines of installation system 10, but also to monitor the productivity of the system (e.g. totals of rivets set each given factory shift). In an operative embodiment of the invention, assembly 97 takes the form of the Timer Counter Access Terminal of Allen-Bradley, Milwaukee, Wis., and CPU 150 consists of the SLC 100 Programmable Controller of Allen-Bradley.

Automated Operation

Reference should again be had to FIG. 1 for an explanation of the start up and operation of the rivet installation apparatus 10 in its automated mode. In order to initiate an operating cycle, the pneumatic switch on the operator panel 100 should be in its "ON" position energizing solenoid valve SV7 to allow the input of high-pressure air from the supply 80, which air must be above the threshold pressure to be detected by pressure switch PS1. Transfer slide 45, transfer arm 43 and slidably mounted tool 50 must all be in their retracted positions, as verified by proximity sensors PX1, PX6 and PX2, which illuminate their respective system status lights. The mandrel collection system container 68 must be latched closed as indicated by PX9. A rivet must be in transfer arm 43 from the previous cycle and held there by the vacuum from vacuum transducer T1. Rivet feed track 23 must contain a supply of rivets sufficient to trigger the proximity sensor PX8. If all of the above conditions are met, a "cycle ready" light will be illuminated.

In order to initiate a rivet installation cycle, the operator presses a "start cycle" push button, causing the following sequence of events to occur under electronic control. Solenoid valve SV1 is energized to advance transfer slide 45. This triggers proximity sensor PX3 and causes SV6 to energize and transfer arm 43 to advance. Transfer arm 43 upon reaching its advanced position triggers sensor PX7 causing valve SV3 to energize. This turns the vacuum in transfer arm 43 to a positive pressure blowing rivet 5 into the nosepiece 51. Once the rivet is seated in the nosepiece 51, a vacuum is formed in the mandrel collection 68 which is detected by the vacuum switch VS1.

As one of its most significant self-diagnostic features, the apparatus 10 is able to detect the failure to insert a rivet into the nosepiece 10 within a reasonable period, and to take corrective action if such insertion is not detected. (Typically, such a failure is caused by a faulty rivet). The positive pressure state caused by valve SV3 lasts for a preset period after which if vacuum switch VS1 has not been triggered, valve SV3 de-energizes for a period drawing rivet 5 back into transfer arm 43. After completion of this period, valve SV3 is again energized and a second attempt is made to blow rivet into nosepiece 51. Again, if switch 51 is not triggered after a fixed period, SV3 is de-energized to draw the rivet back into transfer arm 43. Solenoid valve SV6 is now deenergized retracting transfer arm 43. Once the retraction of arm 43 is detected by de-energizing PX7, but before the arm reaches PX6, valve SV3 is momentarily energized and the faulty rivet discarded with a blast of air. When transfer arm 43 is fully retracted triggering PX6, solenoid valve SV1 is de-energized and transfer slide 45 is retracted. Transfer slide 45 reaching its retracted position triggers PX1, thereby causing valve SV5 to be energized loading a rivet into the transfer tube 38 for delivery to the transfer assembly 40. A fixed time is allotted from the time of triggering switch PX1 (transfer slide retracted) for transferring a rivet to the transfer arm 43. After this time, the operational sequence described above for inserting a rivet into the nosepiece 51 is repeated, and if the second attempt fails the system shuts down.

Once a rivet is in the nosepiece 51 and switch VS1 is triggered, solenoid valve SV6 is de-energized, retracting transfer arm 43 and triggering switch PX6. Triggering of this switch energizes valve SV2 and simultaneously de-energizes valve SV1, advancing the tool 50 within tool slide 85, and retracting the transfer slide 45. The advance tool 50 triggers PX4, causing valve SV4 to energize for a fixed period (illustratively, 0.8 seconds) to set the rivet. Simultaneously, once transfer slide 45 has retracted, triggering switch PX2, valve SV5 is energized and another rivet is transported to transfer arm 43. After the fixed setting time, valve SV4 is de-energized and the tool 50 depressurized via quick-dump valves QDV1 and QDV2, releasing the spent mandrel through the mandrel collection hose 60. Also upon completion of the rivet setting period, solenoid valve SV2 is de-energized and valve SV1 simultaneously is energized, retracting tool 50 and advancing the transfer slide 45. Alternatively, tool 51 may include one or more sensors to detect the breaking of the mandrel of rivet 5, and the actions described in the two immediately preceding sentences may be keyed to this sensor output rather than to a fixed setting period. Various conditions must be detected before solenoid valve SV6 can be energized to advance the transfer arm 43 for loading another rivet into the nosepiece and beginning another rivet installation cycle: the retraction of tool 50 (PX2 triggered); transfer slide 45 in its advanced position (PX3 triggered); and the detection of a spent mandrel leaving installation tool 50 (ring proximity sensor PX5 triggered).

Figure 4:
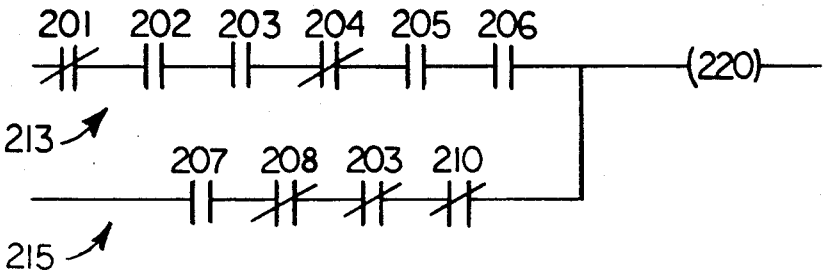
FIGS. 4–6 are ladder logic schematic diagrams representing portions of the control software for the CPU of FIG. 3; specifically.
Figure 5:
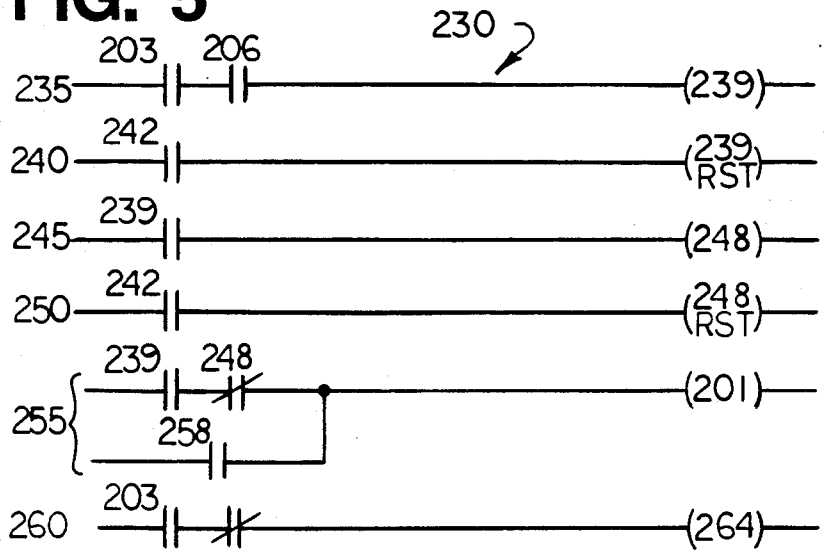
Figure 6:
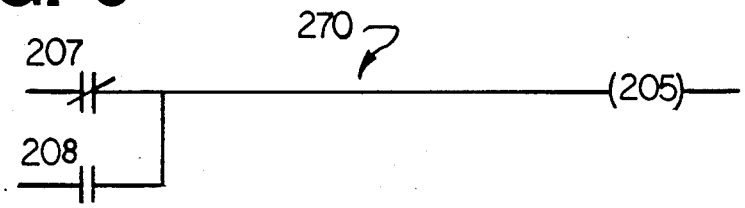

FIGS. 4–6 illustrate in ladder diagram format the use of software control to effect a portion of the above operational sequence, i.e. the loading of a rivet into the installation tool 50. In the diagram 200 of FIG. 4, the schematic elements 201–210 represent various addresses within central processing unit 150 inputs, outputs, timer/counter addresses, or internal addresses which are set by the control program, such as latch bits. In order to achieve the resultant state indicated at 220, either all of the addresses 201–206 must be in their required states or all of addresses 207–210 in their required states. Vertical parallel lines indicate addresses at which a high state is required, while parallel lines intersected by a diagonal indicate that a low state is required. As illustrated below with reference to FIG. 5, the CPU scans through a plurality of ladder logic rungs in sequence, testing the appropriate address states and inducing the indicated resultant address state if appropriate.

FIG. 4 represents the preconditions to achieving an output for inducing a positive pressure within transfer arm 43 (i.e. to energize SV3); the functions of addresses 201–210 are given in TABLE 5. Branch 213 (addresses 201–206) represent the conditions required to load a rivet into the tool 50. The input/output functions of addresses 202–204 and 206 are self-evident. "Loader Pressure Off" is an internal bit which is set upon two failures to load a rivet, as described below with reference to FIG. 5. "Pressure On, Vacuum Off" is an internal bit which remains high for a preset period during nose load, and which is reset for a second try at loading a rivet after a fixed period has elapsed from transporting a second rivet to the transfer arm. Internal bit 205 is set by the ladder rung 270 (FIG. 6), which precedes rung 220, wherein 207, 208 are timer addresses with functions explained below. Branch 215 (addresses 207–210) represents the conditions required to discard a faulty rivet after an unsuccessful try at insertion into tool 50. Addresses 207 and 208 signify that the rivet insertion period has elapsed and the timer for reloading transfer arm 43 has not run. Under these conditions, if transfer arm is between its retracted and advanced positions (addresses 209, 210 low), valve SV3 will be energized.

TABLE 5

ADDRESS FUNCTIONS, FIG. 4

| Address | Function |
|---|---|
| 201 | Loader Pressure Off |
| 202 | Rotator Advanced Called (SV6 Loaded) |
| 203 | Rotator Advanced (PX7 Energized) |
| 204 | Rivet in Nose (VS1 Energized) |
| 205 | Pressure On, Vacuum Off |
| 206 | Latch-Mandrel Sensed (PX5 Energized) |
| 207 | Timer - Load Nose |
| 208 | Timer - Rivet Transfer, Second Load |
| 210 | Rotator Retracted (PX6 Energized) |
| 220 | Loader Pressure On (SV3 Loaded) |

FIG. 5 and TABLE 6 should be consulted together to follow the logical sequence involved in the two pressure cycle for loading rivets into tool 50 (abnormal operation—unsuccessful rivet insertion).

TABLE 6

ADDRESS FUNCTIONS, FIG. 5

| Address | Function |
|---|---|
| 203 | Rotator Advanced (PX7 Energized) |
| 206 | Latch-Mandrel Sensed |
| 239 | Pressure On Timer Cycle |
| 242 | Transfer Slide Retracted (PX1 Energized) |
| 239 RST | Pressure On Timer Cycle - Reset |
| 248 | Pressure Off Timer cycle |
| 248 RST | Pressure Off Timer Cycle - Reset |
| 258 | Shut Off Air Timer (Retry Failure) |
| 201 | Loader Pressure Off |
| 204 | Rivet in Nose (VS1 Energized) |
| 264 | Time Allowed for Nose Load |

At rung 235 if transfer arm (rotator) 43 is "out" and the mandrel sensed latch 238 is set, retentative timer on (RTO) address 239 is set, causing a timer to run for a fixed "pressure on" period. Address 239 is reset at rung 240 if the transfer slide has returned to its retracted position. The timing out of RTO 239 sets RTO 248, for a second, "pressure off", period. Again, RTO 248 is reset by the transfer slide's returning to its home position. At rung 255, internal bit 201 (discussed above with reference to FIG. 4) is set either during the indicated states of timer addresses 239, 248, or after a failure to insert a rivet on reload (address 258).

At 260 upon a failed first insertion, indicated by rotation out and no rivet detected, RTO 264 is set. This defines a total permitted period for inserting a rivet in nosepiece 51.

Semi-Automated Operation

When rivet installation system 10 is used with handheld tool 50, various electronically controlled events are timed to the pressing and release of a trigger on tool 50. Upon energizing the system, a rivet is loaded into the nosepiece 51 (if none is present). Upon detection of a rivet in the nosepiece, rotator 43 and cylinder 48 are caused to move to their home (retracted) positions, whereupon a transfer arm receives a new rivet. The operator presses the trigger for rivet setting, and release of the trigger permits escape of the spent mandrel. Upon detection of the spent mandrel leaving the tool, a new rivet is inserted into the nosepiece.

In the semi-automated mode of operation, if the loading of a rivet into the nosepiece is unsuccessful, there is no automatic retry at insertion but upon observing this the operator may press the trigger to discard the faulty rivet and re-attempt loading the nosepiece. If the rivet setting operation has not succeeded, similarly, the operator may try again by releasing and again pressing the trigger.

While reference has been made to specific embodiments, it will be apparent to those skilled in the art that various modifications and alterations may be made thereto without departing from the spirit of the present invention. Although the illustrated embodiment drives the various mechanisms pneumatically using solenoid valves as control elements, hydraulic drives are also feasible, so that the term "fluidic drives" refers to either of these possibilities. In addition, other drive elements such as electric motors may be employed in lieu of fluidic drives.

We claim:

1. Improved apparatus for successively setting separable mandrel rivets of the type including an installation tool for receiving rivets in a gripping and tensioning mechanism at an apertured receiving end of the tool, and ejecting separated mandrels; a rivet presentation assembly for successively delivering mandrel rivets from a supply to the gripping and tensioning mechanism of the istallation tool; and a mandrel collection assembly for drawing separated mandrels from the tool and routing these to a remote receptacle; wherein the mandrel collection assembly incorporates a channel under negative pressure connecting the installation tool to the remote receptacle; wherein the improvement comprises first means for monitoring the delivery of mandrel rivets to the installation tool, said first monitoring means comprising pressure sensor means for recognizing a predetermined negative pressure condition in said mandrel collection system indicative of the presence of a mandrel rivet at the gripping and tensioning mechanism and outputting signals indicating the presence or absence of a rivet;

second means for monitoring the exiting of separated mandrels from the tool, said second monitoring means comprising means for sensing the passage of a spent mandrel throught the channel of the mandrel collection assembly and outputting a "mandrel sensed" signal in such event; and processor means responsive to the signals from the first and second monitoring means, for controlling the operation of said rivet setting apparatus.

2. Apparatus as defined in claim 1, wherein the rivet presentation assembly comprises a transfer means having a retracted position for receiving a mandrel rivet and an advanced position for aligning said rivet with the apertured end of said installation tool and inserting the rivet to the gripping and tensioning means, further comprises first and second sensing means for detecting the presence of said transfer means at its retracted and advanced positions, respectively, and providing output signals to the processor means in such events, wherein the processor means is additionally responsive to the outupt signals from the first and second sensing means.

3. Apparatus as defined in claim 2 wherein the processor means is responsive to the first and second sensing means to command the delivery of a rivet to the transfer means, and the insertion of a rivet into the installation tool, respectively.

4. Apparatus as defined in claim 1 wherein the second monitoring means comprises a proximity sensor located adjacent the channel of the mandrel collection assembly.

5. Apparatus as defined in claim 1 wherein the first monitoring means comprises a vacuum transducer coupled to the mandrel collection assembly channel.

6. Apparatus as defined in claim 1 wherein the processor means produces command signals in response to the signals from the first and second monitoring means, further comprising a plurality of solenoid valves responsive to respective command signals for fluidically actuating various mechanisms of such apparatus.

7. Apparatus as defined in claim 1 further comprising means for reciprocating the installation tool between retracted and advanced positions, and means for sensing the separation of a mandrel within the installation tool and providing a "mandrel separated" signal to the reciprocating means in such event, wherein the reciprocating means is responsive to the "mandrel separated" signal to move the tool to its retracted position.

8. Apparatus as defined in claim 1 further comprising means for reciprocating the installation tool between advanced and retracted positions, said reciprocating means being responsive to the rivet present signal from the first monitoring means to move the tool to its advance position.

9. In an apparatus for successively installing mandrel rivets, of the type including a rivet installation tool having a setting mechanism for receiving rivets and installing them in workpieces, and rivet presentation means for successively delivering rivets from a supply to the rivet installation tool for installation, said rivet presentation means including a transfer device for succesively receiving and retaining rivets from the supply at a first position removed from the location of the workpiecs, transporting the retained rivet in a predetermined orientation to a second position proximate the setting mechanism, and inserting rivets into the setting mechanism, a plurality of mechanisms of said rivet installing apparatus being moved by fluidic drives, a plurality of pressure sensors for detecting predetermined pressure conditions within said installation apparatus, and producing output signals in such events.

a plurality of location sensors for detecting predetermined locations of various of said mechanisms, and producing output signals in such events.

a plurality of electronically actuated valves for actuating corresponding fluidic drives in response to command signals, and control means for selectively producing said command signals in responsive to predetermined output signals from the pressure sensors and location sensors.

10. Apparatus as defined in claim 9 wherein the fluidic drives are pneumatic drives, and the electronically actuated valves are solenoid valves.

11. Apparatus as defined in claim 9 wherein the pressure sensor means comprises means for detecting the presence of a rivet in the application tool and producing a "rivet present" output signal, wherein the control means produces a command signal causing motion of the transfer means from its first to its second position in response to the "rivet present" output signal.

12. Apparatus as defined in claim 9 wherein one of said location sensors senses the placement of the transfer member at its first position and produces an output signal accordingly, and the control means causes delivery of a rivet to the transfer means in response said output signal.

13. Apparatus as defined in claim 9 wherein one of said location sensors senses the placement of said transfer device at its second position, further comprising fluidically powered means for inserting the riget from the transfer device into the setting mechanism, wherein the control means produces a command signal to said fluidically powered inserting means in response to the output signal indicating that the transfer device is at its second position

14. A method for installing mandrel rivets using a rivet installation tool having a nosepiece for receiving rivets, a setting mechanism within the nosepiece for setting the rivets into workpieces and breaking of the mandrel, and further using an automated rivet presentation assembly for successively delivering rivets from a supply to the nosepiece, and a mandrel collection assembly having a channel under vacuum for routing broken off mandrels from said tool, comprising the steps of attempting to deliver a rivet from a bulk supply to the setting mechanism, automatically monitoring the presence or absence of a rivet at the setting mechanism, and in response thereto signalling whether or not a rivet has been received during a defined delivery period; and in response to a signal indicating a rivet has not been received during the defined period, discarding the rivet from the automated rivet presentation assembly and re-attempting delivery of a new rivet to the tool's setting mechanism.

15. A method as defined in claim 14, further comprising the step in the event the signal indicates the rivet has not been received in the defined period, of reattempting delivery of the same rivet at least once, discarding the rivet only if such reattemp is unsuccessful.

16. A method as defined in claim 14, wherein the delivery step comprises the sequential steps of transporting a rivet to a position and orientation aligned with the setting mechanism, and inserting said rivet from such position into the setting mechanism.

17. A method as defined in claim 14, wherein the presence or absence of a rivet at the setting mechanism is monitored by detecting the internal pressure within the mandrel collection assembly

18. A method as defined in claim 14, further comprising the steps of sensing the exiting of a broken off mandrel from the installation tool, and in response thereto causing the rivet presentation assembly to deliver a new rivet to the setting mechanism.

19. A method for installing mandrel rivets using a rivet installation tool having a nosepiece for receiving rivets, a setting mechanism within the nosepiece for setting the rivets into workpieces and breaking of the mandrel, and further using an automated rivet presentation assembly for successively delivering rivets from a supply to the nose piece, a mandrel collection assembly for routing broken off mandrels from said tool, and a tool reciprocating device for moving the tool between a retracted position wherein it receives rivets from the rivet presentation assembly and an advanced position where it sets rivets into workpieces, comprising the steps of sensing the presence of a rivet within the nosepiece using a first sensor and in response to a signal from said first sensor to said tool reciprocating device, causing the tool to move from its retracted position to its advanced position; and sensing the breaking off of a mandrel within the tool using a second sensor and in response to a signal from said secod sensor to said tool reciprocating device, causing the tool to move from its advanced position to its retracted position.

20. Apparatus for automatically positioning a rivet in a predetermined, desired orientation and location, and inserting the rivet into a tool having a mechanism for installing the rivet in a workpiece, comprising:

a transfer member having a chamber accessible via an exterior opening to releasably house the rivet;

a vacuum transducer controlled by a solenoid valve in fludic communication with the chamber, for inducing a negative pressure in the chamber to attract and hold the rivet therein, and for changing the negative pressure to a positive pressure on command to expel the rivet; and means for transporting the transfer member between a "retracted position" removed from the location of said workpiece and an "advanced position" adjacent to the mechanism in the tool, wherein the rivet is delivered from a supply to the opening of the transfer member while said transfer member is in its retracted position and under negative pressure, thereby causing the delivered rivet to be drawn into the chamber and held by the transfer member, to be subsequently transported to the advanced position where the rivet is propelled to the mechanism of the tool.

* * * * *